US009905245B2

(12) United States Patent
Ida

(10) Patent No.: US 9,905,245 B2
(45) Date of Patent: Feb. 27, 2018

(54) ELECTRONIC DEVICE AND CONTROL METHOD

(71) Applicant: Kabushiki Kaisha Toshiba, Minato-ku, Tokyo (JP)

(72) Inventor: Tomotaka Ida, Kumagaya Saitama (JP)

(73) Assignee: KABUSHIKI KAISHA TOSHIBA, Tokyo (JP)

( * ) Notice: Subject to any disclaimer, the term of this patent is extended or adjusted under 35 U.S.C. 154(b) by 0 days.

(21) Appl. No.: 15/046,238

(22) Filed: Feb. 17, 2016

(65) Prior Publication Data

US 2016/0163330 A1 Jun. 9, 2016

Related U.S. Application Data

(63) Continuation of application No. PCT/JP2013/084959, filed on Dec. 26, 2013.

(51) Int. Cl.
*G10L 21/028* (2013.01)
*G10L 21/0356* (2013.01)
(Continued)

(52) U.S. Cl.
CPC ..... *G10L 21/028* (2013.01); *G10H 1/0091* (2013.01); *G10L 21/0208* (2013.01);
(Continued)

(58) Field of Classification Search
CPC . G10L 21/028; G10L 21/0208; G10L 21/034; G10L 21/0356; G10H 1/0091; G10H 2210/046; H04R 1/1083
(Continued)

(56) References Cited

U.S. PATENT DOCUMENTS 8,457,954 B2 6/2013 Takeuchi et al.
9,224,392 B2 12/2015 Hirohata
(Continued)

FOREIGN PATENT DOCUMENTS

JP 2000-152394 A 5/2000
JP 2002-076964 A 3/2002
(Continued)

OTHER PUBLICATIONS

International Search Report (JP/EN) and Written Opinion (Japanese language only) mailed by Japan Patent Office dated Apr. 1, 2014 in the corresponding PCT Application No. PCT/JP2013/084959—9 pages.

*Primary Examiner* — Vivian Chin
*Assistant Examiner* — Douglas Suthers
(74) *Attorney, Agent, or Firm* — Knobbe, Martens, Olson & Bear, LLP

(57) ABSTRACT

According to one embodiment, an electronic device includes a receiver and a hardware processor. The receiver is configured to receive an audio signal. The hardware processor is configured to enable a first function comprising separating the audio signal into a voice signal and a background sound signal and emphasizing or suppressing either the voice signal or the background sound signal and enable a second function comprising giving an acoustic effect to the audio signal. The hardware processor is further configured to receive an user operation to turn on either the first function or the second function and restrict the second function, if the first function is turned on.

8 Claims, 10 Drawing Sheets

(51) Int. Cl.

| | |
|---|---|
| ***G10L 21/034*** | (2013.01) |
| ***G10H 1/00*** | (2006.01) |
| ***G10L 21/0208*** | (2013.01) |
| *H04R 1/10* | (2006.01) |

(52) U.S. Cl.
CPC ..... *G10L 21/034* (2013.01); *G10L 21/0356* (2013.01); *G10H 2210/046* (2013.01); *H04R 1/1083* (2013.01)

(58) Field of Classification Search
USPC ..... 700/94; 381/10, 56, 333
See application file for complete search history.

(56) References Cited

U.S. PATENT DOCUMENTS

| | | | | |
|---|---|---|---|---|
| 2012/0029913 | A1 | 2/2012 | Takeuchi et al. | |
| 2013/0035933 | A1 | 2/2013 | Hirohata | |
| 2015/0071449 | A1* | 3/2015 | Ozcan ..... | H04R 29/00 381/56 |

FOREIGN PATENT DOCUMENTS

| | | | |
|---|---|---|---|
| JP | 2002-159099 | A | 5/2002 |
| JP | 2006-270507 | A | 10/2006 |
| JP | 2012-032447 | A | 2/2012 |
| JP | 2013-037152 | A | 2/2013 |
| JP | 2013-050604 | A | 3/2013 |

* cited by examiner

ELECTRONIC DEVICE AND CONTROL METHOD

CROSS-REFERENCE TO RELATED APPLICATIONS

This application is a continuation of International Application No. PCT/JP2013/084959, filed on Dec. 26, 2013, the entire contents of which are incorporated herein by reference.

FIELD

Embodiments described herein relate generally to an electronic device and a control method.

BACKGROUND

Sound source separation techniques have lately been developed. These techniques separate, with respect to video audio, an audio signal according to a sound source having a unique attribute to thereby perform an appropriate audio correction of the audio signal by each sound source before synthesizing and outputting the audio signal by each sound source.

Such a sound source separation technique typically separates the audio signal into a voice component that represents human voice and a background sound component that represents sound other than the human voice. The voice component and the background sound component are then individually subjected to emphasis control of, for example, volume to thereby achieve effects of, for example, making the human voice easier to catch or suppressing the human voice.

Such a sound source separation function may be mounted on an electronic device that can perform various types of acoustic effect processing for the audio signal and output audios, such as an audio television set, a personal computer (PC), or a tablet terminal. In such cases, a need exists for achieving acoustic effects under an optimally adjusted condition.

BRIEF DESCRIPTION OF THE DRAWINGS

A general architecture that implements the various features of the invention will now be described with reference to the drawings. The drawings and the associated descriptions are provided to illustrate embodiments of the invention and not to limit the scope of the invention.

DETAILED DESCRIPTION

In general, according to one embodiment, an electronic device comprises a receiver and a hardware processor. The receiver is configured to receive an audio signal. The hardware processor is configured to enable a first function comprising separating the audio signal into a voice signal and a background sound signal and emphasizing or suppressing either the voice signal or the background sound signal and enable a second function comprising giving an acoustic effect to the audio signal. The hardware processor is further configured to receive an user operation to turn on either the first function or the second function and restrict the second function, if the first function is turned on.

The embodiments to be described hereunder represent an exemplary television to which an electronic device is applied. The embodiments are not, however, limited to the application of the electronic device to the television. The electronic device can be applied, for example, to any device that can output audio such as a PC and a tablet terminal.

First Embodiment

Figure 1:
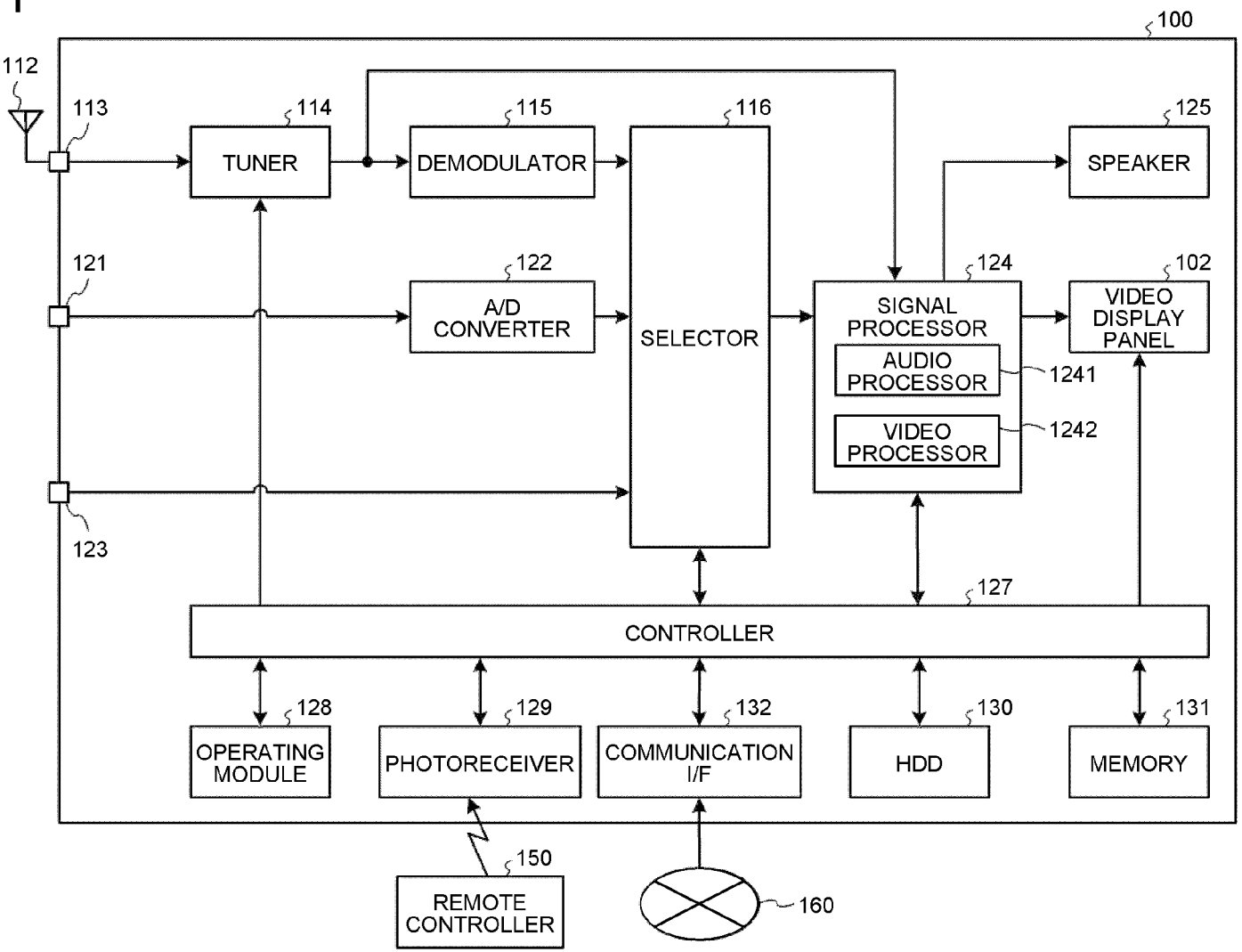
FIG. 1 is an exemplary block diagram of a configuration of a television according to a first embodiment.

As illustrated in FIG. 1, a television 100 in a first embodiment is a stationary video display device that receives broadcast waves of digital broadcasting and displays videos of programs using video signals extracted from the received broadcast waves. The television 100 also has a recording and reproducing function.

As illustrated in FIG. 1, the television 100 comprises an antenna 112, an input terminal 113, a tuner 114, and a demodulator 115. The antenna 112 captures the broadcast waves of the digital broadcasting and supplies broadcast signals of the broadcast waves to the tuner 114 via the input terminal 113.

The tuner 114 selects a broadcast signal of a desired channel from the broadcast signals of the digital broadcasting input thereto. The broadcast signal output from the tuner 114 is supplied to the demodulator 115. The demodulator 115 subjects the broadcast signal to demodulation, demodulates a digital video signal and an audio signal, and supplies the demodulated signals to a selector 116 to be described later.

The television 100 further comprises input terminals 121 and 123, an A/D converter 122, a signal processor 124, a speaker 125, and a video display panel 102.

The input terminal 121 receives inputs of an analog video signal and an analog audio signal from the outside. The input terminal 123 receives inputs of a digital video signal and a digital audio signal from the outside. The A/D converter 122 converts the analog video signal and the analog audio signal that are supplied from the input terminal 121 into corresponding digital signals and supplies the digital signals to the selector 116.

The selector 116 selects one of the digital video and audio signals supplied from the demodulator 115, the A/D converter 122, and the input terminal 123 and supplies the selected signal to the signal processor 124.

The television 100 further comprises at least a TS demultiplexer and an MPEG decoder. The signal processor 124 receives an input of a signal that has been decoded by the MPEG decoder. The signal processor 124 also receives an input of a signal that represents program data or moving-image data that is recorded in a hard disk drive (HDD) 130 or an external storage medium, such as a digital versatile disc (DVD) and a Blu-ray (registered trademark) disc, and subjected to decoding.

The signal processor 124 comprises an audio processor 1241 and a video processor 1242. The video processor 1242 subjects the input video signal to certain processings including signal processing and scaling processing, and supplies the processed video signal to the video display panel 102. In addition, the video processor 1242 generates an on-screen display (OSD) signal to be displayed on the video display panel 102. It is noted that the video processor 1242 and the video display panel 102 are an exemplary display.

The audio processor 1241 subjects the input digital audio signal received from the selector 116 to certain signal processing, converts the digital audio signal into a corresponding analog audio signal, and outputs the analog audio signal to the speaker 125. The speaker 125 receives an input of the audio signal supplied from the signal processor 124 and outputs audios using the audio signal. The audio processor 1241 in the first embodiment has a sound source separation function. The audio processor 1241 will be described in detail later.

The video display panel 102 comprises a flat panel display such as a liquid crystal display or a plasma display. The video display panel 102 displays videos using the video signals supplied from the signal processor 124.

The television 100 further comprises a controller 127, an operating module 128, a photoreceiver 129, the HDD 130, a memory 131, and a communication I/F 132.

The controller 127 integrally controls various operations in the television 100. The controller 127 comprises a microprocessor that has, for example, a central processing unit (CPU) incorporated therein. The controller 127, while receiving an input of operation information from the operating module 128, receives via the photoreceiver 129 an input of operation information transmitted from a remote controller 150. The controller 127 controls each module in accordance with the foregoing operation information. The photoreceiver 129 in the first embodiment receives infrared light from the remote controller 150.

In this case, the controller 127 uses the memory 131. The memory 131 mainly comprises a read only memory (ROM) that stores a control program executed by the CPU incorporated in the controller 127, a random access memory (RAM) that provides the CPU with a work area, and a nonvolatile memory that stores, for example, various types of setting information and control information.

The HDD 130 has a function as a storage for storing the digital video and audio signals that are selected by the selector 116. The television 100, because of the HDD 130 included therein, can record the digital video and audio signals selected by the selector 116 as recorded data in the HDD 130. Furthermore, the television 100 can reproduce videos and audios using the digital video and audio signals recorded in the HDD 130.

The communication I/F 132 is connected to various types of communication devices (e.g., a server) via a public network 160. The communication I/F 132 can receive programs and services that can be used in the television 100 and transmit various types of information.

Figure 2:
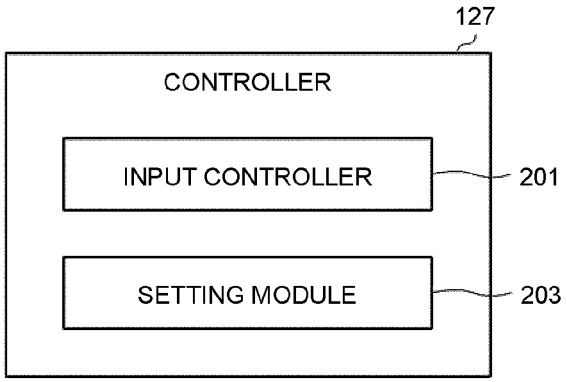
FIG. 2 is an exemplary block diagram of a functional configuration of a controller in the first embodiment.

The following describes a functional configuration executed by the controller 127. As illustrated in FIG. 2, the controller 127 in the first embodiment functions as an input controller 201 and a setting module 203.

The input controller 201 receives, via the photoreceiver 129, an operating input on the remote controller 150 by a user. The input controller 201 also receives an operating input on the operating module 128. In the first embodiment, the input controller 201 receives from the user a setting input that specifies whether the sound source separation function is activated and, when the sound source separation function is activated, a setting input of a volume (strength of emphasis) of a voice and a background sound. Additionally, the input controller 201 receives a setting input of an acoustic effect from the user.

The audio signal is composed of a signal of a human voice component and a signal of a background sound component that represents, for example, music other than the human voice. The voice component signal will hereinafter be referred to a voice signal and the background sound component signal will hereinafter be referred to as a background sound signal. The sound source separation function separates the audio signal into the voice signal and the background sound signal and emphasizes either the voice signal or the background sound signal. The sound source separation function is performed by the audio processor 1241.

The setting module 203 makes various settings from the user and stores the settings in, for example, the memory 131. In the first embodiment, the setting module 203 stores the setting of, for example, whether the sound source separation function is activated, the setting of the volume (degree of emphasis) of the voice and the background sound, and the setting of the acoustic effect received by the input controller 201, in the memory 131 for example.

Figure 3:
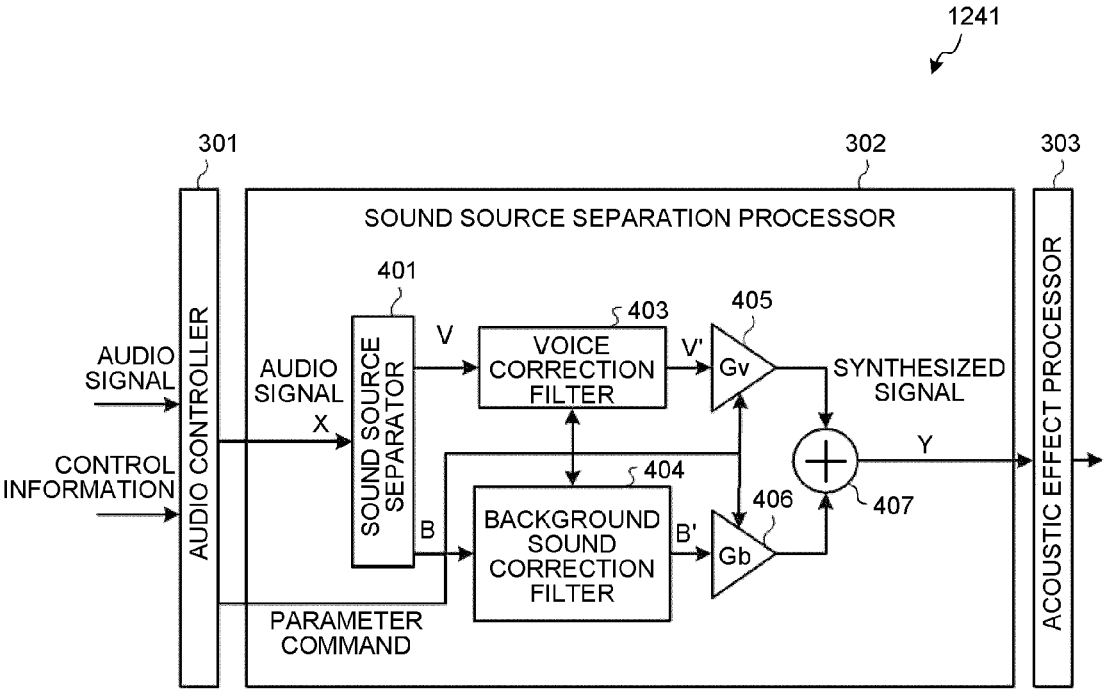
FIG. 3 is an exemplary diagram of a configuration of an audio processor in the first embodiment.

The following describes the audio processor 1241 of the signal processor 124 in detail. As illustrated in FIG. 3, the audio processor 1241 in the first embodiment comprises an audio controller 301, a sound source separation processor 302, and an acoustic effect processor 303.

When the user specifies to activate (perform) the sound source separation function, the audio controller 301 controls the sound source separation processor 302 to perform the sound source separation function and controls the acoustic effect processor 303 not to perform an acoustic effect function that gives the audio signal an acoustic effect.

The audio controller 301 outputs the input audio signal to the sound source separation processor 302 to thereby activate the sound source separation function. Thereby, the audio controller 301 controls the sound source separation processor 302 to emphasize the audio signal. To activate the sound source separation function, the audio controller 301 outputs a parameter command together with the audio signal to the sound source separation processor 302. This parameter command is a parameter for emphasizing or suppressing the voice or the background sound.

The sound source separation processor 302 separates an audio signal X into a voice signal and a background sound signal and performs the sound source separation function that emphasizes or suppresses the voice signal or the background sound signal. As illustrated in FIG. 3, the sound source separation processor 302 comprises a sound source separator 401, a voice correction filter 403, a background sound correction filter 404, a gain Gv 405, a gain Gb 406, and an adder 407.

The sound source separator 401 separates the input audio signal into a voice component V (a voice signal V) and a background sound component B (a background sound signal B). The sound source separator 401 may employ any technique for separating the audio signal. Examples of the technique for separating the audio signal employed by the sound source separator 401 include, but are not limited to, the technique disclosed in Japanese Patent Application Laid-open No. 2013-37152.

The voice correction filter 403 corrects a characteristic of the voice signal V on the basis of the parameter command and outputs a corrected voice signal V'. The background sound correction filter 404 corrects a characteristic of the background sound signal B on the basis of the parameter command and outputs a corrected background sound signal B'.

These correction filters 403 and 404 are available in a number of varieties, including a type that uses correlation between surround channels on the basis of a constant value (gain adjustment only). For example, a filter that emphasizes a voice frequency characteristic, as applied, for example, to a hearing aid may be used for the voice correction filter 403 to process the voice signal V, in order to make the voice alone easier to catch without affecting the background component. For the background sound correction filter 404, various other types of filters may be used, including a filter that strengthens a frequency band that has been excessively suppressed by the sound source separation process, a filter that applies an aural effect using a technique similar to a technique employed in an equalizer attached to, for example, a music player, and a filter that incorporates what is called a simulated surround technology when the background sound signal is a stereo signal.

The corrected voice signal V' after the correction by the voice correction filter 403 is multiplied by the gain Gv 405. The corrected background sound signal B' after the correction by the background sound correction filter 404 is multiplied by the gain Gb 406.

The audio processor 1241 in the first embodiment causes the audio controller 301 to receive an input of the parameter command. The audio processor 1241 varies strength of the corrections made by the voice correction filter 403 and the background sound correction filter 404 according to the parameter command and varies the gain Gv 405 and the gain Gb 406 according to the parameter command. This operation results in the voice being emphasized or suppressed on the basis of the parameter command received by the voice correction filter 403 and the gain Gv 405 and the background sound being emphasized or suppressed on the basis of the parameter command received by the background sound correction filter 404 and the gain Gb 406.

The adder 407 adds the voice signal multiplied by the gain Gv 405 to the background sound signal multiplied by the gain Gb 406 and outputs a resultant synthesized signal Y.

The acoustic effect processor 303 applies various acoustic effects set by the user to the synthesized signal Y and outputs a resultant audio signal. When the audio controller 301 disables the acoustic effects to cancel the acoustic effects, the acoustic effect processor 303 stores the setting details of the acoustic effects being executed in, for example, the memory 131. Examples of the acoustic effects include, but are not limited to, surround effect, dynamic bass boost, and graphic equalizer.

Figure 4:
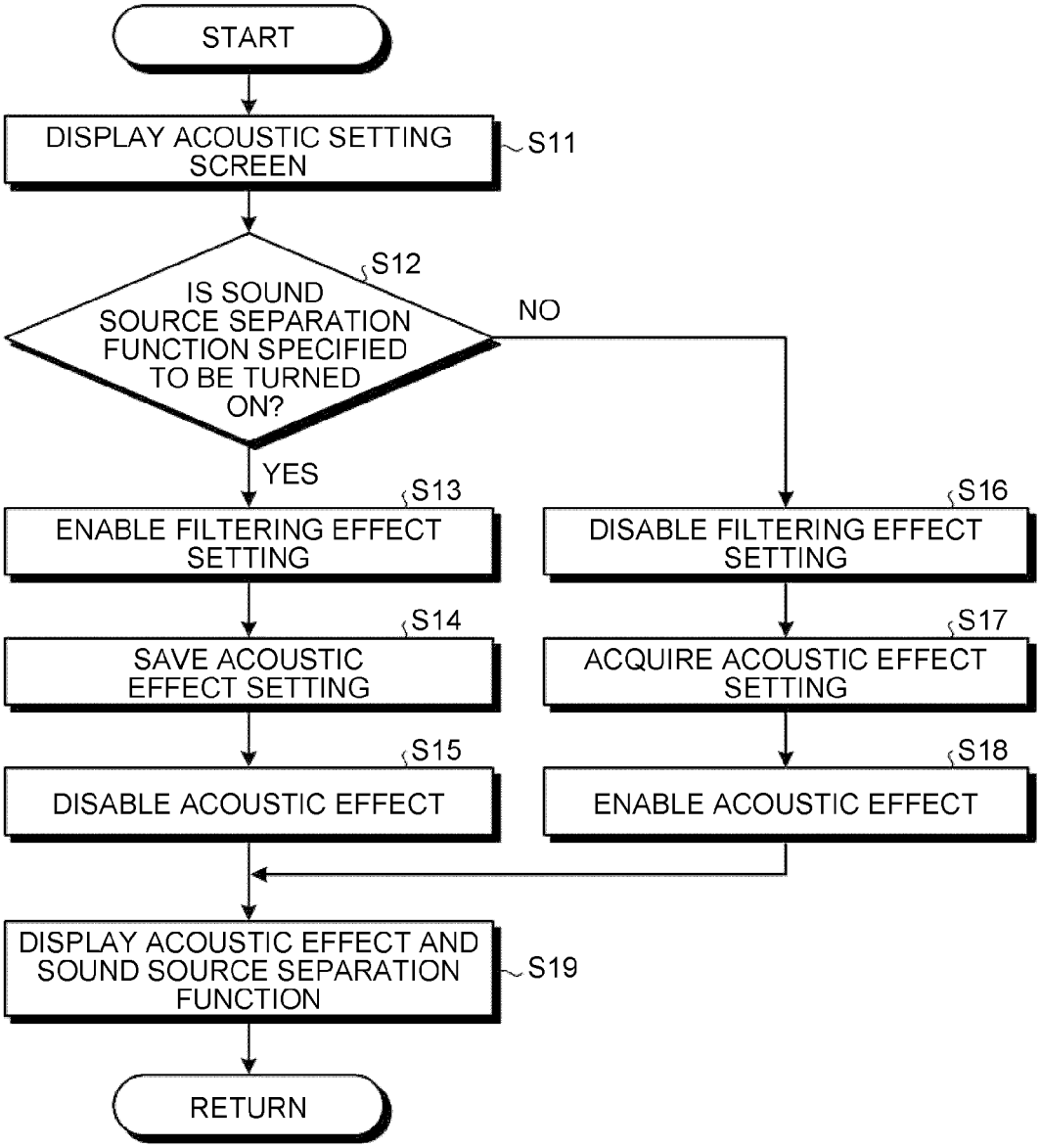
FIG. 4 is an exemplary flowchart illustrating a procedure of an audio control process in the first embodiment.

The following describes, with reference to FIG. 4, an audio control process performed by the television 100 in the first embodiment having configurations as described above. The video processor 1242 of the signal processor 124 displays an acoustic setting screen as the OSD on the video display panel 102 (S11). The acoustic setting screen allows the user to specify whether the sound source separation function is activated, to specify the strength of emphasis of voice and background sound when the sound source separation function is activated, and to set various acoustic effects.

Figure 5:
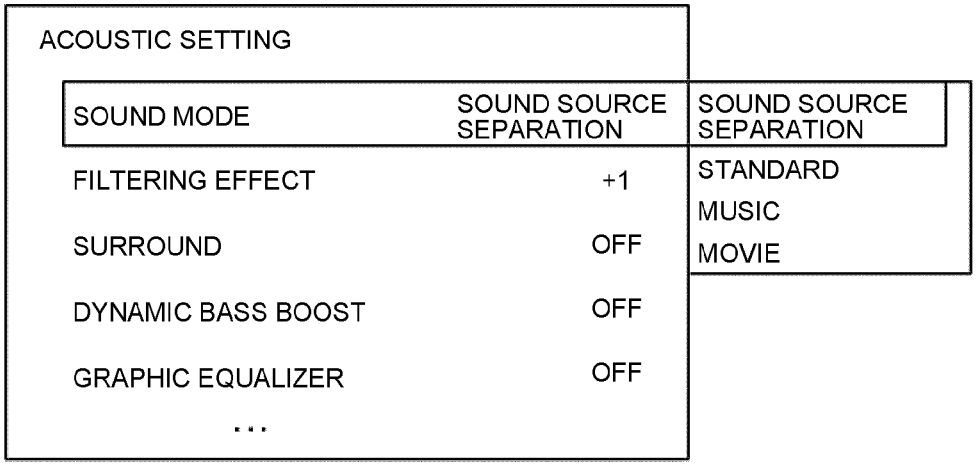
FIG. 5 is an exemplary diagram of an acoustic setting screen in the first embodiment.

FIG. 5 is an exemplary diagram of the acoustic setting screen in the first embodiment. As illustrated in FIG. 5, when "sound mode" is selected on the acoustic setting screen, a sound mode screen appears on the right side of the screen, allowing the user to select the type of the sound mode. When the user selects "sound source separation" on the sound mode screen, the sound source separation function is turned ON and is to be activated. When the user selects an item other than the sound source separation, such as "standard", "music", or "movie", the sound source separation function is turned OFF and is not be activated.

Reference is made back to FIG. 4. If the sound source separation function has been specified to be turned ON (Yes at S12), the audio controller 301 enables setting of a filtering effect (S13).

Specifically, in the acoustic setting screen illustrated in FIG. 5, if "sound source separation" is selected in the sound mode to turn ON the sound source separation function, the audio controller 301 enables the setting of "filtering effect".

Figure 6:
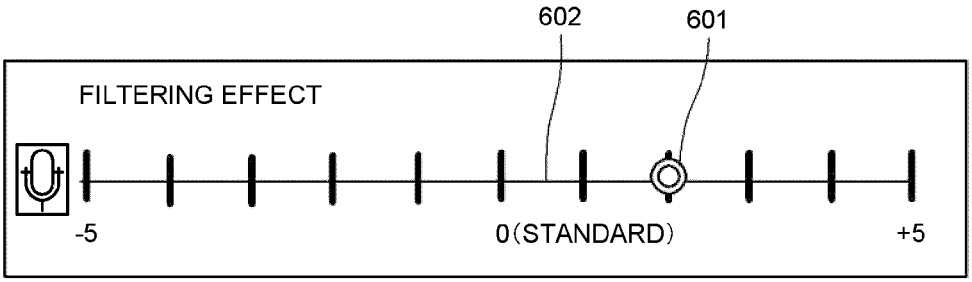
FIG. 6 is an exemplary diagram of a filtering effect setting screen in the first embodiment.

If the user selects this "filtering effect", the video processor 1242 displays a filtering effect setting screen on the video display panel 102. The filtering effect setting screen allows the user to specify strength of emphasis of the voice and the background sound when the sound source separation function is turned ON. FIG. 6 is an exemplary diagram of the filtering effect setting screen in the first embodiment.

The example of FIG. 6 illustrates that a balance between the strength of the voice and the strength of the background sound can be specified as the filtering effect in eleven steps from "−5" to "+5" of graduations on a bar 602. In FIG. 6, the "−" direction emphasizes the background sound component, while the "+" direction emphasizes the voice component.

The filtering effect value of "−5" indicates that the background sound component alone is output with a substantially zero output of the voice component. The filtering effect value of "0" indicates a standard default value that results in an output of the voice component and the background sound component with an equal strength (volume). The filtering effect value of "+5" indicates that the voice component alone is output with a substantially zero output of the background sound component.

On the filtering effect setting screen, the user slides a specifying button 601 along the bar 602 to thereby set a desired filtering effect. The input controller 201 receives the input of the setting for the filtering effect specified on the filtering effect setting screen. It is noted that the filtering effect setting screen and the filtering effect steps are not limited to those illustrated in FIG. 6 and may be set as otherwise necessary.

The audio controller 301 transmits the parameter command based on the value set for the filtering effect to the sound source separation processor 302. The voice correction filter 403 and the background sound correction filter 404 of the sound source separation processor 302 then perform filtering processes for the voice signal and the background sound signal, respectively, according to the parameter command, so that the voice signal and the background sound signal are emphasized according to the balance specified by the filtering effect setting.

The acoustic effect processor 303 saves details of the current acoustic effect settings in, for example, the memory 131 (S14). The audio controller 301 performs a procedure of disabling the acoustic effects (S15). Specifically, the audio controller 301 performs the following processing.

"Surround", "dynamic bass boost", and "graphic equalizer" in the acoustic setting screen illustrated in FIG. 5 represent the acoustic effect settings. When the user selects "sound source separation" in "sound mode" to thereby turn ON the sound source separation function, the audio controller 301 performs the procedure of disabling the acoustic effects, which disables the user from setting the acoustic effects. It is noted that these acoustic effect items are enabled when the user selects an item other than "sound source separation" in "sound mode" to thereby turn OFF the sound source separation function.

The settings of the sound source separation function, the filtering effect, and various acoustic effects illustrated in FIG. 5 are merely illustrative and should not be construed to be restrictive.

As the procedure of disabling the acoustic effects, the audio controller 301 cancels specification of all parameters relating to the acoustic effects by the acoustic effect processor 303 and controls the acoustic effect processor 303 not to give acoustic effects to the synthesized audio signal.

The foregoing control results in the following. Specifically, turning ON the sound source separation function disables the user from setting the acoustic effects on the acoustic setting screen; in addition, the audio signal input to the audio processor 1241 goes through the sound source separation processor 302. Thereafter, the audio signal is input to the acoustic effect processor 303 and is output without being given the acoustic effects.

If the user specifies to turn OFF the sound source separation function at S12 (No at S12), the audio controller 301 disables the setting of the filtering effect (S16). Specifically, the audio controller 301 disables the user from setting the "filtering effects" on the acoustic setting screen illustrated in FIG. 5. In addition, the audio controller 301, when outputting the audio signal input thereto to the sound source separation processor 302, outputs to the sound source separation processor 302 the parameter command that specifies values not emphasizing or suppressing the voice signal and the background sound signal. As a result, the filters and the gains in the sound source separation processor 302 do not emphasize or suppress both the voice signal and the background sound signal.

The audio controller 301 acquires the acoustic effect settings saved in, for example, the memory 131 (S17) and performs a procedure of enabling the acoustic effects according to the acquired settings (S18). Specifically, the audio controller 301 performs the procedure of enabling the acoustic effects, which enables, in the acoustic setting screen illustrated in FIG. 5, each of the acoustic effects of "surround", "dynamic bass boost", and "graphic equalizer" to be selected. Additionally, as the procedure of enabling the acoustic effects, the audio controller 301 sets the parameters relating to the acoustic effects specified by the acoustic effect processor 303 according to the settings acquired at S17 and controls the acoustic effect processor 303 to give the acoustic effects to the audio signal.

Figure 7:
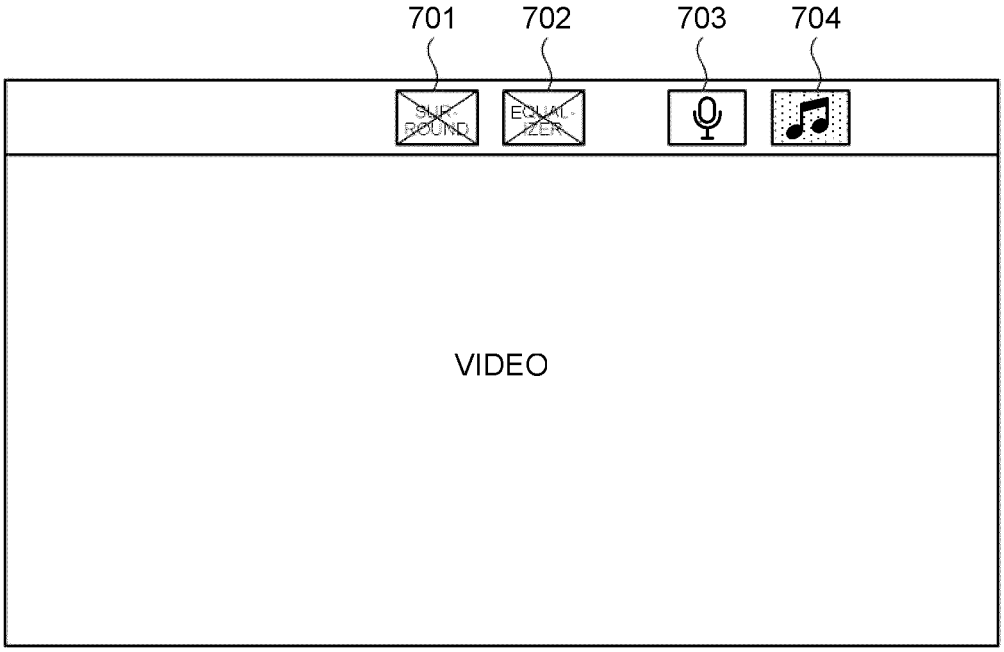
FIG. 7 is an exemplary diagram illustrating a display of acoustic effects and a sound source separation function in the first embodiment.

The video processor 1242, when displaying a video on the video display panel 102, displays as the OSD statuses of the acoustic effect and the sound source separation function on a video screen (S19). Specifically, the video processor 1242 displays the current acoustic effect settings and the component emphasized by the sound source separation function. FIG. 7 is an exemplary diagram illustrating a display of statuses of the acoustic effects and the sound source separation function in the first embodiment.

As illustrated in FIG. 7, the area above the video displays the current acoustic effect settings (reference numerals 701 and 702) and a specific component (reference numeral 704) emphasized by the sound source separation function. The example of FIG. 7 illustrates that the sound source separation function is turned ON and that the voice is not emphasized by reference numeral 703 and the background sound is emphasized by reference numeral 704. The example of FIG. 7 further illustrates that, for the acoustic effects, the surround function is disabled by reference numeral 701 and the graphic equalizer function is disabled by reference numeral 702. The exemplary screen displaying the statuses of the acoustic effects and the sound source separation function illustrated in FIG. 7 is merely illustrative and should not be construed to be restrictive.

When the sound source separation function is mounted on an electronic device of, for example, the television 100, the sound source separation function may be incompatible with common acoustic effect settings. Acoustic effects may not be optimally adjusted, either, even when acoustic effect processing is performed for an audio signal that has undergone the filtering process of emphasizing or suppressing the voice or background sound through the sound source separation function.

In the first embodiment, when the user sets to turn ON the sound source separation function, the sound source separation processor 302 is controlled so as to perform the sound source separation function and the acoustic effect processor 303 is controlled not to perform the acoustic effect function by which the acoustic effects are given to the audio signal as described above. This arrangement allows the effect of emphasizing or suppressing the voice or the background sound achieved by the sound source separation function to be optimally exhibited without being reduced by the acoustic effects. The first embodiment thus can achieve the acoustic effects in an optimally adjusted state even with the electronic device provided with the sound source separation function.

Second Embodiment

In the first embodiment, when the sound source separation function is specified to be turned ON, the television 100 invariably disables the acoustic effects. When the strength of emphasis of the voice is equal to or lower than the strength of emphasis of the background sound, however, application of the acoustic effects to the audio signal is considered to affect little because the voice is not emphasized. A television 100 in the second embodiment, therefore, does not disable the acoustic effects even with the sound source separation function specified to be turned ON, if the filtering effect is set such that the strength of emphasis of the background sound is greater than the strength of emphasis of the voice.

The television 100 and an audio processor 1241 in the second embodiment have configurations identical to those of the television 100 in the first embodiment and the audio processor 1241 in the first embodiment. A controller 127 in the second embodiment has a functional configuration identical to that of the controller 127 in the first embodiment.

Figure 8:
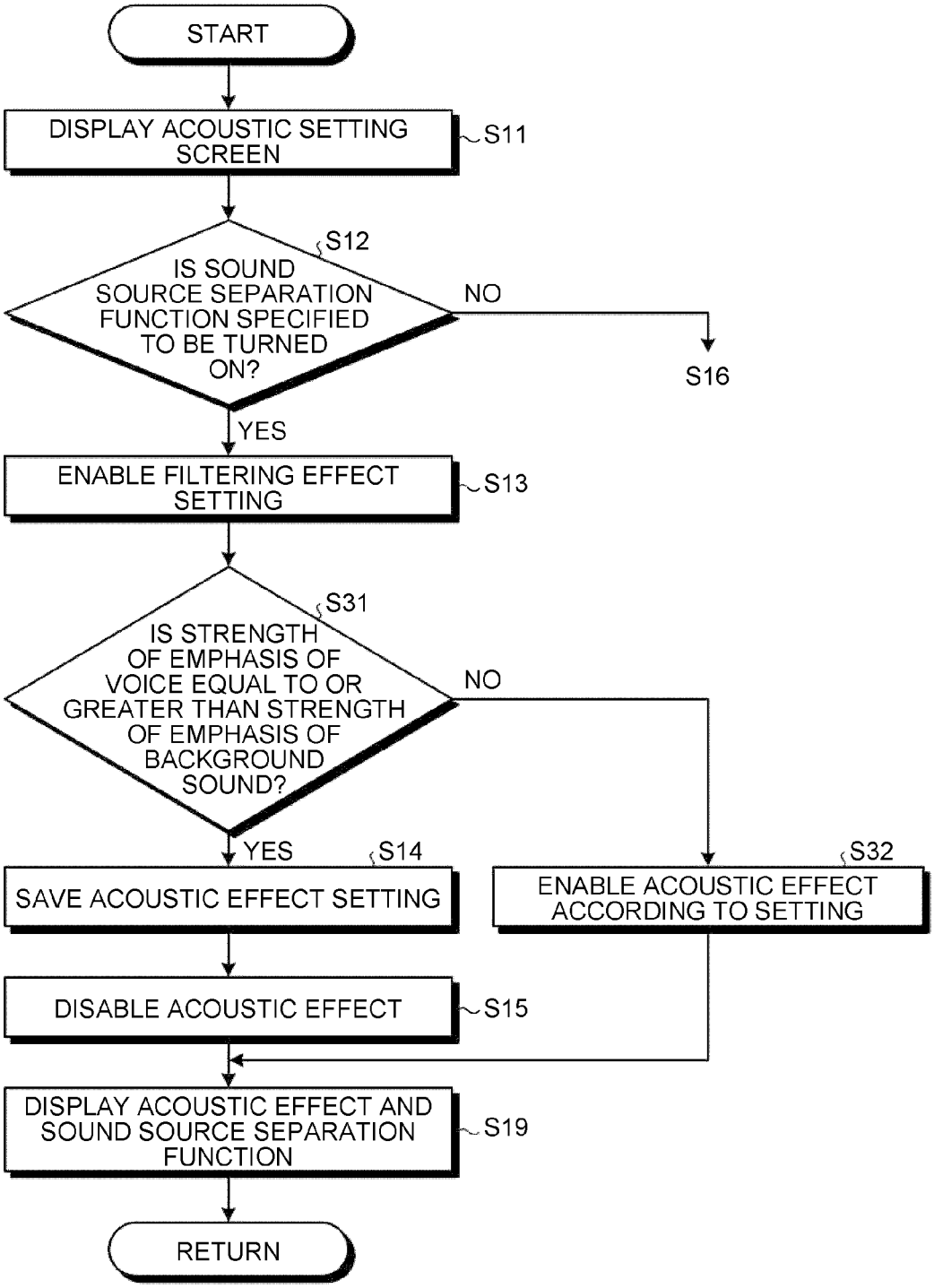
FIG. 8 is an exemplary flowchart illustrating a procedure of an audio control process according to a second embodiment.

FIG. 8 is an exemplary flowchart illustrating a procedure of an audio control process according to the second embodiment. As in the first embodiment, a video processor 1242 displays the acoustic setting screen (S11) and an audio controller 301 determines whether the user has specified to turn ON the sound source separation function (S12). If the sound source separation function has been specified to be turned OFF (No at S12), the process proceeds to S16 and the same process is performed as in the first embodiment.

If the user specifies on the acoustic setting screen to turn ON the sound source separation function at S12 (Yes at S12), the audio controller 301 enables the setting of the filtering effect (S13).

The audio controller 301 determines in the setting of the filtering effect by the user whether the strength of emphasis of the voice signal is equal to or greater than the strength of emphasis of the background sound signal (S31). If the strength of emphasis of the voice signal is equal to or greater than the strength of emphasis of the background sound signal (Yes at S31), an acoustic effect processor 303 saves the current acoustic effect settings in, for example, a memory 131 as in the first embodiment (S14). The audio controller 301 performs the procedure of disabling the acoustic effects and controls the acoustic effect processor 303 not to perform the acoustic effect function (S15).

If, at S31, the strength of emphasis of the voice signal is determined to be smaller than the strength of emphasis of the background sound signal in the setting of the filtering effect by the user (No at S31), the audio controller 301 does not perform the procedure of disabling the acoustic effects, and performs the procedure of enabling the acoustic effects according to the setting details and controls the acoustic effect processor 303 to perform the acoustic effect function (S32).

Thereafter, as in the first embodiment, the video processor 1242 displays the acoustic effect and the sound source separation function (S19).

As described above, the television 100 in the second embodiment does not disable the acoustic effects even with the sound source separation function specified to be turned ON, if the filtering effect is set such that the strength of emphasis of the background sound is greater than the strength of emphasis of the voice. The acoustic effects can thereby be optimally exhibited, if the acoustic effects do not affect the emphasis of the voice even with the sound source separation function enabled. The second embodiment thus can achieve the acoustic effects in an optimally adjusted state even with the electronic device provided with the sound source separation function.

Third Embodiment

A television 100 in a third embodiment, in addition to performing the functions described in the first and second embodiments, performs the procedure of disabling the sound source separation function and restores the acoustic effect function upon detection of a certain timing during performance of the sound source separation function.

Figure 9:
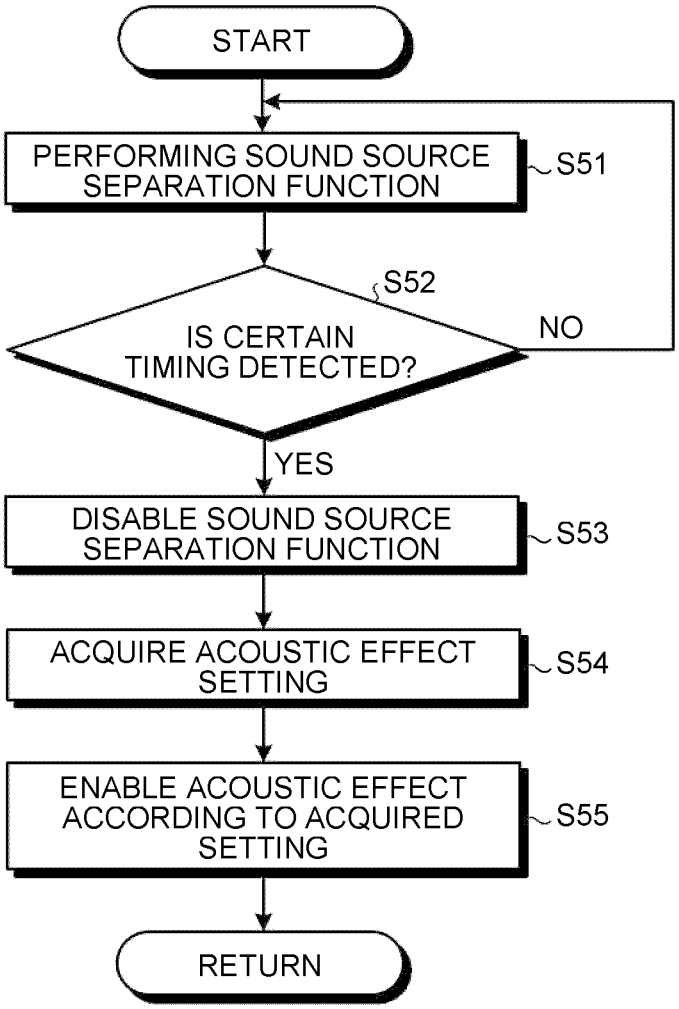
FIG. 9 is an exemplary flowchart illustrating a procedure of an audio control process according to a third embodiment.

The television 100 and an audio processor 1241 in the third embodiment have configurations identical to those of the television 100 in the first embodiment and the audio processor 1241 in the first embodiment. A controller 127 in the third embodiment has a functional configuration identical to that of the controller 127 in the first embodiment. FIG. 9 is an exemplary flowchart illustrating a procedure of an audio control process according to the third embodiment.

An audio controller 301 in the third embodiment is in a state of waiting for detection of a certain timing (No at S52) during performance of the sound source separation function by the sound source separation processor 302 (S51). The audio controller 301, upon detecting the certain timing (Yes at S52), performs the procedure of disabling the sound source separation function; specifically, the audio controller 301 controls the sound source separation processor 302 to stop the performance of the sound source separation function (S53).

In performing the procedure of disabling the sound source separation function, specifically, the audio controller 301 outputs, together with the audio signal, a parameter command that sets 1 for a gain Gv 405 without changing the strength of a voice correction filter 403 and a parameter command that sets 1 for a gain Gb 406 without changing the strength of a background sound correction filter 404 to the sound source separation processor 302, thereby not to emphasize or suppress the voice and the background sound.

The procedure of disabling the sound source separation function is not limited to the above-described approach. Alternatively, the audio controller 301 may be configured so as to output the audio signal to the acoustic effect processor 303 without having the sound source separation processor 302 intervening therebetween, to thereby perform the procedure of disabling the sound source separation function.

The audio controller 301 acquires the acoustic effect settings saved in, for example, a memory 131 to thereby restore the acoustic effect settings before the performance of the sound source separation function (S54). The audio controller 301 then performs the procedure of enabling the acoustic effects based on the restored settings; specifically, the audio controller 301 controls the acoustic effect processor 303 to give the acoustic effects (S55).

Examples of the certain timing include switching a broadcast channel, switching a broadcast program, switching an input device, turning ON power after it has been turned OFF, switching between a Commercial Message (CM) scene and a main program scene, and a start or an end of a music piece.

Specifically, the audio controller 301, upon receipt of a switching of a channel performed by the user on an operating module 128 or a remote controller 150, detects the event of the receipt of the switching as the certain timing and controls the sound source separation processor 302 and the acoustic effect processor 303 to disable the sound source separation function and restore the acoustic effect function.

The television 100 receives an electronic program guide (EPG) through the broadcast waves of the digital broadcasting at regular time intervals. The audio controller 301 refers to the EPG, detects as the certain timing a timing at which the program that is currently viewed by the user is changed to another, and controls the sound source separation processor 302 and the acoustic effect processor 303 to disable the sound source separation function and restore the acoustic effect function.

When a switching of the input device is detected as the user connects, for example, a gaming machine or a high-definition multimedia interface (HDMI; a registered trademark) to the input terminal, the audio controller 301 detects the input switching timing as the certain timing and controls the sound source separation processor 302 and the acoustic effect processor 303 to disable the sound source separation function and restore the acoustic effect function.

The controller 127 also performs scene detection for detecting a scene in a broadcast program or a recorded program and outputs resultant scene information. The scene information represents data that records a scene type of the specific scene detected through the scene detection, and a starting time-of-day and an ending time-of-day of the scene. The scene type represents, for example, a main program scene, a CM scene, a song scene, and a scene other than song.

The audio controller 301 acquires the scene information from the controller 127, detects as the certain timing a timing at which the scene of a program being broadcast or a program being reproduced is changed from the main program scene to the CM scene, and controls the sound source separation processor 302 and the acoustic effect processor 303 to disable the sound source separation function and restore the acoustic effect function.

In addition, the controller 127 can perform music piece detection in a broadcast or recorded program. When a start or an end of a music piece is detected through the music piece detection, the audio controller 301 detects a timing of that particular detection as the certain timing and controls the sound source separation processor 302 and the acoustic effect processor 303 to disable the sound source separation function and restore the acoustic effect function.

Figure 10:
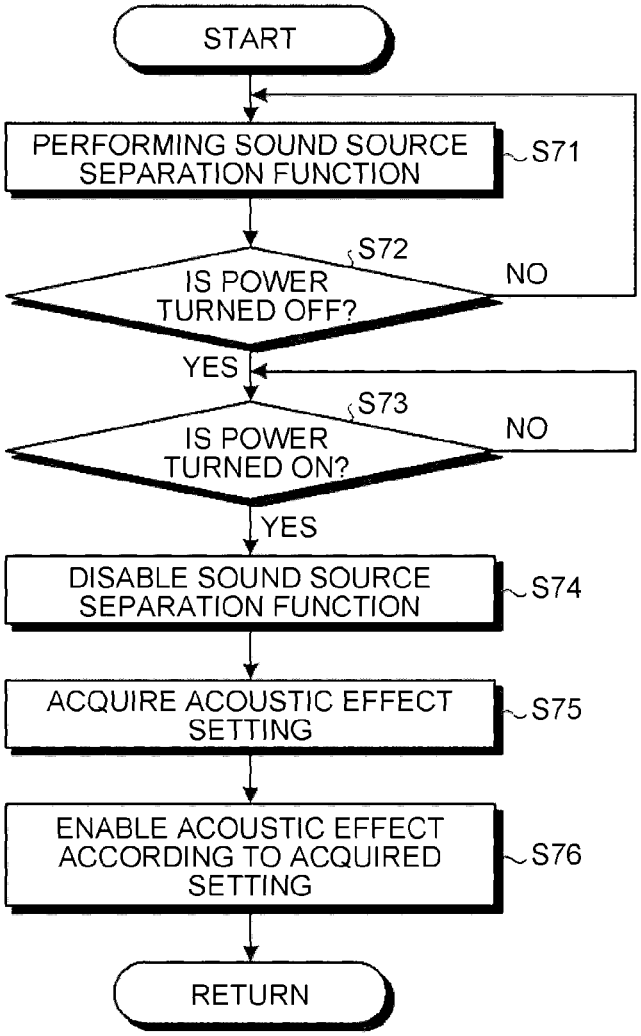
FIG. 10 is an exemplary flowchart illustrating a procedure of an audio control process in the third embodiment.

As illustrated in FIG. 10, in a case where the user shuts down power (power OFF) (Yes at S72) during performance of the sound source separation function (S71) and thereafter turns ON the power (power ON) (Yes at S73), the audio controller 301 detects the timing at which the power is turned ON following the power OFF event as the certain timing. The audio controller 301 disables the sound source separation function (S74) and controls the sound source separation processor 302 and the acoustic effect processor 303 to restore and perform the acoustic effect function (S75 and S76).

As described above, the television 100 in the third embodiment performs, upon detection of a certain timing during performance of the sound source separation function, the procedure of disabling the sound source separation function to thereby restore the acoustic effect function. Specifically, in the third embodiment, the acoustic effect settings before the performance of the sound source separation function are restored when the sound source separation function is disabled at a certain timing of a specific operation. This arrangement eliminates the need for the user to restore original acoustic effect settings and prevents the sound source separation function from causing false recognition that specific sound is inaudible. The third embodiment thus can achieve the acoustic effects in an optimally adjusted state even with the electronic device provided with the sound source separation function.

Fourth Embodiment

The television 100 in the third embodiment invariably disables the sound source separation function and restores the acoustic effect function when a certain timing is detected during the performance of the sound source separation function. In a fourth embodiment, a television 100 disables the sound source separation function and restores the acoustic effect function when the user specifies to restore the acoustic effect function.

The television 100 and an audio processor 1241 in the fourth embodiment have configurations identical to those of the television set 100 in the first embodiment and the audio processor 1241 in the first embodiment. A controller 127 in the fourth embodiment has a functional configuration identical to that of the controller 127 in the first embodiment.

Figure 11:
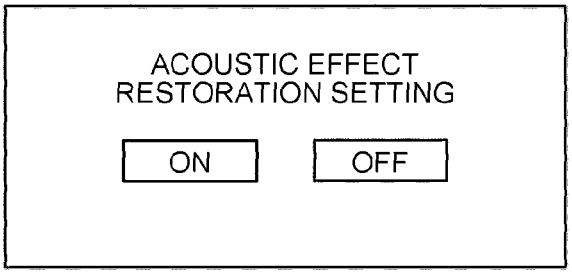
FIG. 11 is an exemplary diagram of an acoustic effect restoration setting screen according to a fourth embodiment.

In the fourth embodiment, the user can specify in advance on an acoustic effect restoration setting screen whether the acoustic effects are restored upon detection of a certain timing. FIG. 11 is an exemplary diagram of the acoustic effect restoration setting screen according to the fourth embodiment.

As illustrated in FIG. 11, on the acoustic effect restoration setting screen, whether the acoustic effects are to be restored can be set upon detection of a certain timing. In the example illustrated in FIG. 11, the acoustic effects are restored upon detection of the certain timing when "ON" is selected. On the other hand, the acoustic effects are not restored and the sound source separation function is not disabled even upon detection of the certain timing when "OFF" is selected.

The setting of the restoration through the use of the acoustic effect restoration setting screen is performed prior to, for example, initial setting. The specific settings to be restored through the use of the acoustic effect restoration setting screen are saved in, for example, memory 31, by a setting module 203.

Figure 12:
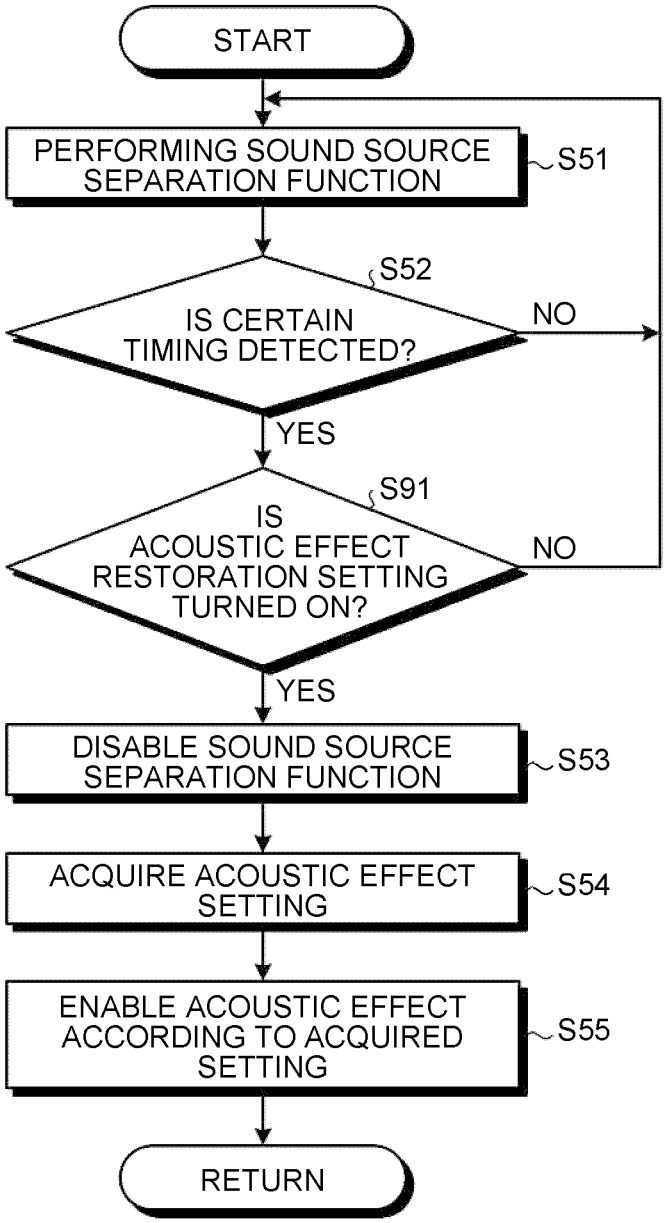
FIG. 12 is an exemplary flowchart illustrating a procedure of an audio control process in the fourth embodiment.

FIG. 12 is an exemplary flowchart illustrating a procedure of an audio control process in the fourth embodiment. As in the third embodiment, if the certain timing is detected (Yes at S52) during performance of the sound source separation function by a sound source separation processor 302 (S51), an audio controller 301 refers to, for example, the memory 131 to thereby determine whether the acoustic effect restoration setting is turned ON (S91).

If the acoustic effect restoration setting is turned OFF (No at S91), the process returns to S51. Specifically, the audio controller 301 controls the sound source separation processor 302 to continue performing the sound source separation function and controls an acoustic effect processor 303 not to perform the acoustic effect function.

If the acoustic effect restoration setting is turned ON (Yes at S91), the audio controller 301, as in the third embodiment, disables the sound source separation function (S53), acquires the acoustic effect settings to restore it (S54), and enables the acoustic effect function on the basis of the restored settings; specifically, the audio controller 301 controls the acoustic effect processor 303 to give the acoustic effects (S55).

As described above, in the fourth embodiment, the television 100 disables the sound source separation function and restores the acoustic effect function when the user specifies to restore the acoustic effect function. The television 100 in the fourth embodiment does not, therefore, disable the sound source separation function and restore the acoustic effect function even when the certain timing is encountered, if the restoration is not required. The fourth embodiment thus can achieve the acoustic effects in an even more optimally adjusted state even with the electronic device provided with the sound source separation function.

It is noted that the exemplary acoustic effect restoration setting screen illustrated in FIG. 11 allows the entire acoustic effects to be generally restored. The acoustic effect restoration setting screen, the audio controller 301, and the acoustic effect processor 303 may nonetheless be configured so as to allow each individual acoustic effect item to be specified for restoration.

Figure 13:
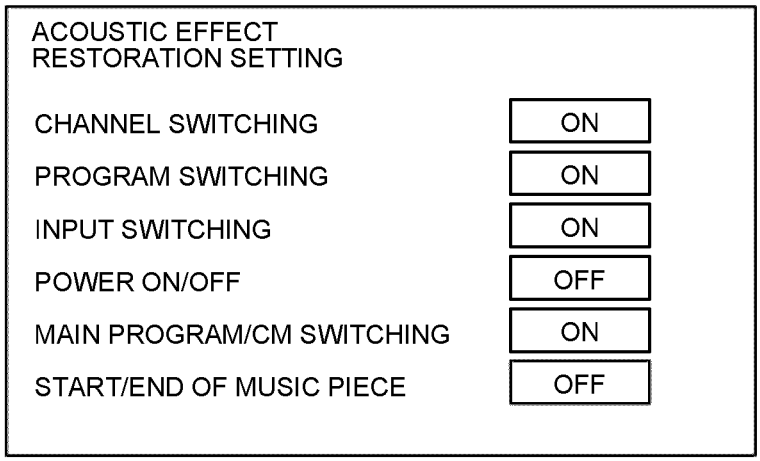
FIG. 13 is an exemplary diagram of an acoustic effect restoration setting screen according to a modification of the fourth embodiment.

An acoustic effect restoration setting screen illustrated in FIG. 13, for example, allows each individual acoustic effect to be specified for restoration when the certain timing is detected. In this case, the audio controller 301 determines the setting of restoration for each individual acoustic effect item.

In the example illustrated in FIG. 13, the acoustic effect items that are set to "ON" are restored upon detection of the certain timing. In contrast, the acoustic effect items that are set to "OFF" are not restored and the sound source separation function is not disabled even when the certain timing is detected.

The television 100 in the fourth embodiment is configured so as to make the acoustic effect restoration setting in advance during, for example, the initial setting. The audio controller 301 and a video processor 1242 may nonetheless be configured so that the acoustic effect restoration setting screen illustrated in FIG. 11 is displayed on a video display panel 102 upon detection of the certain timing to thereby prompt the user to determine whether to disable the sound source separation function and restore the acoustic effects.

An audio control program executed by the television 100 in the first to fourth embodiments is provided as a computer program product by being incorporated in, for example, the ROM of the memory 131 in advance.

The audio control program executed by the television 100 in the first to fourth embodiments may be provided as a computer program product by being recorded on a computer-readable recording medium, such as a compact disc read only memory (CD-ROM), a flexible disk (FD), a compact disc recordable (CD-R), and a digital versatile disc (DVD), in a file in an installable format or an executable format.

The audio control program executed by the television 100 in the first to fourth embodiments may also be configured as a computer program product stored in a computer connected to a network such as the Internet and downloaded over the network. The audio control program executed by the television 100 in the first to fourth embodiments may still be configured as a computer program product provided or distributed over a network such as the Internet.

The audio control program executed by the television 100 in the first to fourth embodiments has a modular configuration including the above-described modules (the input controller 201, the setting module 203, the audio controller 301, the sound source separation processor 302, and the acoustic effect processor 303). Each module is loaded onto the RAM of the memory 131 as a result of the CPU reading the audio control program from the ROM and executing the loaded audio control program.

Moreover, the various modules of the systems described herein can be implemented as software applications, hardware and/or software modules, or components on one or more computers, such as a server. While the various modules are illustrated separately, they may share some or all of the same underlying logic or code.

Moreover, the various modules of the systems described herein can be implemented as software applications, hardware and/or software modules, or components on one or more computers, such as servers. While the various modules are illustrated separately, they may share some or all of the same underlying logic or code.

While certain embodiments have been described, these embodiments have been presented by way of example only, and are not intended to limit the scope of the inventions. Indeed, the novel embodiments described herein may be embodied in a variety of other forms; furthermore, various omissions, substitutions and changes in the form of the embodiments described herein may be made without departing from the spirit of the inventions. The accompanying claims and their equivalents are intended to cover such forms or modifications as would fall within the scope and spirit of the inventions.

What is claimed is:

1. An electronic device comprising:

a receiver configured to receive an audio signal; and a hardware processor configured to selectively perform:

a first function comprising separating the audio signal into a voice signal and a background sound signal and emphasizing or suppressing either the voice signal or the background sound signal, and a second function comprising giving an acoustic effect to the audio signal, wherein the hardware processor is further configured to:

receive a user operation to turn on either the first function or the second function; and perform the second function, if the first function is turned on and if a strength of emphasis of the voice signal is smaller than a strength of emphasis of the background sound signal.

2. The electronic device according to claim 1, wherein the hardware processor is further configured to disable the second function, if the first function is turned on and if a strength of emphasis of the voice signal is equal to or bigger than a strength of emphasis of the background sound signal.

3. The electronic device according to claim 1, wherein the hardware processor is further configured to stop the performance of the first function and perform the second function according to a first setting made before the performance of the first function, if a certain timing is detected during the performance of the first function.

4. The electronic device according to claim 3, wherein the certain timing comprises at least one of a switching of a broadcast channel, a switching of a broadcast program, a switching of an input device, turning on power from a power off state, a switching between Commercial Message (CM) scene and a main program scene, and a start or an end of a music piece.

5. The electronic device according to claim 3, wherein, when a second setting to restore the acoustic effect is set, upon detection of the certain timing while the first function is performed, the hardware processor is further configured to stop the performance of the first function and perform the second function according to the first setting made before the performance of the first function.

6. The electronic device according to claim 5, wherein, when the second setting is not set, upon detection of the certain timing while the first function is performed, the hardware processor is further configured to continue performing the first function and disable the second function.

7. The electronic device according to claim 1, further comprising:

a display configured to display a status of emphasis of the voice signal or the background sound signal in accordance with the first function and a status of the acoustic effect, together with video.

8. A control method by an electronic device comprising:

receiving an audio signal;

selectively performing by a hardware processor:

a first function comprising separating the audio signal into a voice signal and a background sound signal and emphasizing or suppressing either the voice signal or the background sound signal, and a second function comprising giving an acoustic effect to the audio signal;

the method further comprising:

receiving a user operation to turn on either the first function or the second function; and perform the second function, if the first function is turned on and if a strength of emphasis of the voice signal is smaller than a strength of emphasis of the background sound signal.

* * * * *